US010350557B2

(12) United States Patent
Mattson et al.

(10) Patent No.: US 10,350,557 B2
(45) **Date of Patent: *Jul. 16, 2019**

(54) MIXING SYSTEMS, METHODS, AND DEVICES WITH EXTENDIBLE IMPELLERS

(71) Applicant: BAYER CROPSCIENCE LP, Research Triangle Park, NC (US)

(72) Inventors: Douglas J. Mattson, Liberty, MO (US); John F. Gee, Raleigh, NC (US); Jeffrey R. Susalla, Apex, NC (US); Ryan K. Bergman, Olive Branch, MS (US); Ronald R. Renkel, Jr., Southaven, MS (US)

(73) Assignee: BAYER CROPSCIENCE LP, Research Triangle Park, NC (US)

( * ) Notice: Subject to any disclaimer, the term of this patent is extended or adjusted under 35 U.S.C. 154(b) by 181 days.

This patent is subject to a terminal disclaimer.

(21) Appl. No.: 15/610,255

(22) Filed: May 31, 2017

(65) Prior Publication Data

US 2017/0266632 A1 Sep. 21, 2017

Related U.S. Application Data

(63) Continuation of application No. 14/572,883, filed on Dec. 17, 2014, now Pat. No. 9,713,799.
(Continued)

(51) Int. Cl.
*B01F 7/20* (2006.01)
*B01F 7/00* (2006.01)
*B01F 7/22* (2006.01)

(52) U.S. Cl.
CPC ..... *B01F 7/00058* (2013.01); *B01F 7/0025* (2013.01); *B01F 7/00033* (2013.01);
(Continued)

(58) Field of Classification Search
CPC ..... B01F 15/0291; B01F 15/0272; B01F 7/00033; B01F 7/00141; B01F 7/20;
(Continued)

(56) References Cited

U.S. PATENT DOCUMENTS 1,734,120 A 11/1929 Farrington et al.
1,827,004 A 10/1931 Gibson et al.
(Continued)

FOREIGN PATENT DOCUMENTS

CN 2782204 Y 5/2006
CN 2803502 Y 8/2006
(Continued)

OTHER PUBLICATIONS

"Contmixer—Modular Mixers for Containers and Small Tanks. Product Brochure [online]. MAMEC OY, 2013. Retrieved from the Internet: <URL: http://www.mamec.fi/files/114/Contmixer.eng.pdf>."

(Continued)

*Primary Examiner* — Tony G Soohoo
(74) *Attorney, Agent, or Firm* — McBee Moore Woodward & Vanik IP, LLC

(57) ABSTRACT

A mixing device includes a base, shaft, impeller sleeve, and impeller blades. The base can be constructed for releasable attachment to an opening of a container, such as a 55-gallon drum. The shaft extends from the base and is coupled thereto such that rotation can be transmitted to the shaft by way of or through the base. The impeller sleeve is mounted on the shaft and supports the impeller blades. Each impeller blade includes an attachment leg and a stirring leg extending from the attachment leg. The impeller blades are supported so as to transition from a collapsed position with the stirring leg proximal to a central axis of the shaft to an extended position with the stirring leg distal from the central axis when the
(Continued)

shaft is rotated. Each impeller blade can be formed of a plastic, such as a glass-filled polypropylene or glass-filled nylon.

19 Claims, 14 Drawing Sheets

Related U.S. Application Data

(60) Provisional application No. 61/916,898, filed on Dec. 17, 2013.

(52) U.S. Cl.
CPC ..... *B01F 7/00066* (2013.01); *B01F 7/00075* (2013.01); *B01F 7/00141* (2013.01); *B01F 7/00291* (2013.01); *B01F 7/00691* (2013.01); *B01F 7/20* (2013.01); *B01F 7/22* (2013.01); *B01F 7/0005* (2013.01)

(58) Field of Classification Search
CPC .. B01F 7/0025; B01F 7/0005; B01F 7/00058; B01F 7/00066; B01F 2015/00084; B01F 2215/0093; C03C 17/001; C03C 2217/70
USPC ..... 366/191, 196, 308
See application file for complete search history.

(56) References Cited

U.S. PATENT DOCUMENTS 3,455,540 A 7/1969 Marcmann et al.
3,559,962 A 2/1971 Enssle et al.
4,054,272 A 10/1977 Cooke et al.
4,060,224 A 11/1977 Wilson et al.
4,264,215 A 4/1981 Nunlist et al.
4,491,421 A 1/1985 Koehl et al.
4,635,814 A 1/1987 Jones
5,351,850 A 10/1994 Brieskorn
5,356,214 A 10/1994 Styles et al.
5,489,151 A * 2/1996 Weber ..... B01F 7/0005 366/247
5,716,132 A 2/1998 Chou
5,885,001 A * 3/1999 Thomas ..... B01F 7/00066 366/308
5,941,363 A 8/1999 Partyka et al.
5,941,636 A * 8/1999 Lu ..... B01F 7/00066 366/249
5,988,604 A 11/1999 McWhirter et al.
6,047,846 A 4/2000 Watson
6,076,958 A 6/2000 Althouse et al.
6,216,907 B1 4/2001 Morneau
6,247,837 B1 * 6/2001 Wardberg ..... B01F 7/00066 366/129
6,776,518 B2 8/2004 Gartland et al.
6,964,511 B2 11/2005 Rumph
D543,004 S 5/2007 Pomilia
D548,423 S 8/2007 Pomilia
D548,424 S 8/2007 Pomilia
D548,425 S 8/2007 Pomilia
7,318,668 B2 1/2008 Bielozer
7,374,333 B2 5/2008 Eisenkraetzer et al.
7,422,363 B2 9/2008 Parker
7,441,940 B2 10/2008 Vanek
7,887,230 B2 2/2011 Rosso et al.
8,192,071 B2 6/2012 Wright et al.
8,220,986 B2 7/2012 Janz et al.
8,231,087 B1 7/2012 Giordano
8,262,278 B2 9/2012 Yanoff
8,408,418 B2 * 4/2013 Kuzelka ..... B01F 15/00006 220/600
9,074,171 B2 * 7/2015 Gueneron ..... C12M 23/26
9,604,183 B2 * 3/2017 Dinnison ..... B01F 7/00341
9,713,799 B2 7/2017 Mattson et al.
9,855,537 B2 * 1/2018 Williams ..... B01F 15/00681
10,105,662 B1 * 10/2018 Mattson ..... B01F 7/00066
10,118,141 B2 * 11/2018 Larsen ..... B01F 7/00691
2003/0053838 A1 3/2003 Whitney
2004/0089667 A1 * 5/2004 Gargano ..... F16L 55/1108 220/601
2005/0088907 A1 * 4/2005 Vanek ..... B01F 7/00075 366/129
2009/0141586 A1 6/2009 Dyer
2010/0195432 A1 8/2010 Laurence et al.
2011/0205836 A1 8/2011 Lentes et al.
2011/0249529 A1 10/2011 Hirzel
2012/0045834 A1 * 2/2012 Jones ..... B01F 7/00275 435/383
2015/0165396 A1 * 6/2015 Mattson ..... B01F 7/00058 366/279
2016/0193575 A1 7/2016 Dinnison et al.
2017/0266632 A1 * 9/2017 Mattson ..... B01F 7/00058

FOREIGN PATENT DOCUMENTS

DE 2645264 A1 4/1978
WO 1999021647 A1 5/1999
WO 1999054026 A1 10/1999
WO 2000002652 A1 1/2000
WO 2000018948 A1 4/2000
WO 2001034286 A2 5/2001
WO 2002007866 A1 1/2002
WO 2002066148 A1 8/2002
WO 2004054697 A1 7/2004
WO 2004082841 A1 9/2004
WO 2005014155 A1 2/2005
WO 2007045678 A1 4/2007
WO 2007047107 A2 4/2007
WO 2009077125 8/2009
WO 2009143925 A2 12/2009
WO 2010107888 A1 9/2010
WO 2011031144 A2 3/2011
WO 2011100962 A1 8/2011
WO 2012032090 A1 3/2012
WO 2012071673 A1 6/2012
WO 2013151733 A1 10/2013

OTHER PUBLICATIONS

Batch Mixer Portable Direct Drive [online]. Neptune Mixer Company, 2008. Retrieved from the Internet: <URL: http://web.archive.org/web/20080724164053/http://www.neptunemixers . . . >.
Bung Entering Drum Mixers [online]. Neptune Mixer Company, 2008. Retrieved from the Internet: <URL: http://web.archive.org/web/20080724163941/http://www.neptunemixers . . . >.
Bung Mount Drum Mixers and Bridge Mount Tote Mixer. Drawing Sheets. Fusion Fluid Equipment LLC, 2013.
Closed Head Mixer—Drum Mixer for Closed Head Drum Tank [online]. Dynamix Agitators, Inc., 2011. Retrieved from the Internet: <URL: http://web.archive.org/web/20110904041132/http://www.dynamixinc.com . . . >.
DM-101 Drum Mixer Instructions & Parts. Operating Manual [online]. International Pump Manufacturing, Inc., 2008.
Drawing No. 10-1223-5. Parts Sheet. Grovhac, Inc., 2005.
Drawing No. 91-1224. Parts Sheet. Grovhac, Inc., 2004.
Drum Stirrer PMLF. Datasheet [online]. Fluko Fluid Kotthoff GmbH, 2013. Retrieved from the Internet: <URL: https://fluid-kotthoff.de/uploads/tx_flukoprod/drum_stirrer_pmlf.pdf>.
Drum Stirrers—IDM Series [online]. Aqua-Air Engg & Services, 2003. Retrieved from the Internet: <URL: http://web.archive.org/web/20030710130146/http://transflopumps.com/sti . . . >.
Enhanced Classic Line (ECL) Mixers, Portable/Fixed Mount Mixers. Product Brochure [online]. SPX Industrial Processes, 2012. Retrieved from the Internet: <URL: http://www.spx.com/cn/assets/pdf/B-940%20LGT.%20ECL.pdf>.
Folding Impeller Styles for Limited-Access Vessels [online]. Fusion Fluid Equipment, 2012 [retrieved on Jan. 27, 2015]. Retrieved from the Internet: <URL: http://web.archive.org/web/20120810000136/http://www.fusionfluid.com/FusionFluidEquipmentLLC/html/impellers_folding.html>.

(56) References Cited

OTHER PUBLICATIONS

Folding Impeller, 10 inch Diameter, 1 inch Bore [online]. Mixer Direct, 2013. Retrieved from the Internet: <URL: http://www.mixerdirect.com/impellers/medium-shear/folding-impellers/fo . . . >.
HE-3 High Efficiency Impeller. Bulletin. Chemineer, Inc., 1996.
Industrial Drum and Tank Mixers [online]. Dynamix Agitators, Inc., 2011. Retrieved from the Internet: <URL: http://web.archive.org/web/20110902061023/http://www.dynamixinc.com . . . >.
Kukura et al., "Understanding Pharmaceutical Flows," Pharmaceutical Technology, Oct. 2002, pp. 48-72 (even).
Mixing Blades [online]. Grovhac, Inc., 2013. Retrieved from the Internet: <URL: http://www.grovhac.com/mixers-agitators?category-id=93>.
Pail Ring Mount Mixer, 1/2 horsepower, TEFC [online]. Mixer Direct, 2013. Retrieved from the Internet: <URL: http://www.mixerdirect.com/mixers/small-1-50-ga1/5-gal-pail-ring-mount>.
Portable Drum Mixers and Drum Agitators [online]. The Cary Company, 2010. Retrieved from the Internet: <URL:http://web.archive.org/web/20100811191405/http://www.thecarycompany . . . >.
Product Brochure, Neptune Mixer Company, 2013, pp. 7, 9, 10, 14, and 15.
Product Catalogue No. 13-04. Fusion Fluid Equipment, LLC, 2013.
Specialty Mixers—Pipe and Pail-Mount, Hand-Held. Datasheet. Neptune Mixer Company, 1999.
Specialty Mixers—Pipe, Pail, Handle Bar, Pistol Grip Air Mixer [online]. Neptune Mixer Company, 2008. Retrieved from the Internet: <URL: http://web.archive.org/web/20080724164101/http://www.neptunemixers . . . >.
XE-3 High Efficiency Impeller. Bulletin. Chemineer, Inc., 2011.
International Search Report and Written Opinion from corresponding PCT/US2014/070716, dated Mar. 23, 2015.

* cited by examiner

MIXING SYSTEMS, METHODS, AND DEVICES WITH EXTENDIBLE IMPELLERS

CROSS-REFERENCE TO RELATED APPLICATIONS

This application is a continuation of U.S. application Ser. No. 14/572,883, which claims the benefit of U.S. Provisional Application No. 61/916,898, filed Dec. 17, 2013, which are hereby incorporated by reference herein in their entireties.

FIELD

The present disclosure relates generally to mixing of a substance, and, more particularly, to systems, methods, and devices for mixing a substance using extendible impellers.

SUMMARY

Systems, methods, and devices for mixing a substance, in particular by using one or more impellers with extendible blades, are disclosed herein. A mixing device can include a base, a shaft, and an impeller with one or more blades. The base can be releasably attached to an opening of a container, such as a 55-gallon drum. The impeller can be mounted on a shaft coupled to the base and can support the blades to allow displacement of the blades from a collapsed position to an extended position upon rotation of the shaft. The collapsed position can allow the impeller to fit through the relatively narrow opening of the container, while the extended position allows for effective stirring of the substance of the container. Advantageous mixing of substances, such as, but not limited to, heterogeneous mixtures prone to separation of the component ingredients, can be achieved by virtue of the disclosed impeller blade geometries and configurations.

In one or more embodiments, a mixing device can include a base, a shaft, a first impeller sleeve, and at least one first impeller blade. The base can be constructed to be releasably attached to an opening of a container. The shaft can extend from the base and can be coupled thereto such that rotation can be transmitted to the shaft by way of the base. The first impeller sleeve can be mounted on the shaft. Each first impeller blade can have an attachment leg and a stirring leg extending from the attachment leg. Each first impeller blade can be supported by the first impeller sleeve so as to transition from a collapsed position with the stirring leg proximal to a central axis of the shaft to an extended position with the stirring leg distal from the central axis when the shaft is rotated. Each first impeller blade can comprise a plastic material.

In one or more embodiments, a mixing device can include a base, a shaft, and an impeller. The base can be constructed to be releasably attached to an opening of a container. The shaft can be coupled to the base. The impeller can be mounted on the shaft and can include at least two plastic blades constructed to displace from a collapsed position to an extended position upon rotation of the shaft. Each blade can have a first leg and a second leg in cross-section joined together at adjacent edges and at least one support rib extending between the first and second legs. An end of the first leg can be coupled to the impeller. An angle between the first and second legs can be 135° or less, and ratio of a length of the second leg to a length of the first leg can be at least 1.8:1.

In one or more embodiments, a method of mixing a substance in a container can include inserting a mixing device into the container with the substance therein. The mixing device can have a shaft and an impeller mounted thereon. The impeller can include at least two plastic blades coupled thereto by respective bushings. Each blade can be at a collapsed position during the inserting. The method can also include rotating the mixing device such that each plastic blade displaces from the collapsed position to an extended position to mix the substance in the container. The bushings can allow the at least two plastic blades to rotate from the collapsed position to the extended position during the rotating. Each plastic blade can be formed of a glass-filled polypropylene or a glass-filled nylon.

In one or more embodiments, a mixing device comprises an elongated shaft, a first impeller sleeve, and at least two first impeller blades. The elongated shaft has a central axis of rotation. The first impeller sleeve is mounted on the shaft. The at least two first impeller blades comprise an attachment leg and a stirring leg extending from the attachment leg. Each first impeller blade is supported by the first impeller sleeve so as to transition from a collapsed position with the stirring leg proximal to the central axis of the shaft to an extended position with the stirring leg extending away from the central axis when the shaft is rotated.

In one or more embodiments, a mixing device comprises an elongated shaft and an impeller. The elongated shaft has a longitudinal axis. The impeller is mounted on the shaft and comprises at least two blades constructed to displace from a collapsed position to an extended position upon rotation of the shaft. Each blade has a first leg and a second leg in cross-section joined together at adjacent edges and at least one support rib extending between the first and second legs. An end of the first leg is coupled to the impeller. An angle between the first and second legs is 135° or less, and a length of the second leg to a length of the first leg is at least 1.8:1.

In one or more embodiments, a method of mixing a substance in a container comprises inserting a mixing device into the container with the substance therein. The mixing device includes a shaft having a rotation axis and an impeller mounted to the shaft. The impeller includes at least two blades coupled thereto, and each blade is at a collapsed position during the inserting. The method further comprises rotating the shaft about the rotation axis such that each impeller blade displaces from the collapsed position to an extended position, thereby mixing the substance in the container. Each impeller blade has a first leg and a second leg in cross-section joined together at adjacent edges and at least one support rib extending between the first and second legs.

Objects and advantages of embodiments of the disclosed subject matter will become apparent from the following description when considered in conjunction with the accompanying drawings.

BRIEF DESCRIPTION OF DRAWINGS

Embodiments will hereinafter be described with reference to the accompanying drawings, which have not necessarily been drawn to scale. Where applicable, some features may not be illustrated to assist in the illustration and description of underlying features. Throughout the figures, like reference numerals denote like elements.

DETAILED DESCRIPTION

In order to mix a substance held by a container, a mixing device can be inserted into the container. In some applications, the container can be a drum, barrel, tank, or any other container, which may have an opening for access to the interior thereof that is relatively smaller than the size of the container. In order to access the interior of the container, the mixing device, in particular, the impellers thereof should be sized to fit through the opening, which may limit the size of the impellers and thus hamper effective mixing.

In embodiments of the disclosed subject matter, the mixing device employs an impeller configuration that allows the blades to be in a collapsed position to aid in insertion through the relatively smaller opening of the container. Once inside the container, the blades can be extended to thereby provide more effective mixing. The extension of the impeller blades can occur automatically, for example, due to forces arising from rotation of the shaft and/or interaction of the impeller blades with the substance to be mixed. The geometry and configuration of the impeller blades can provide for advantageous mixing of the substance within the container despite having to fit the impeller blades through the reduced size opening of the container.

Figure 1A:
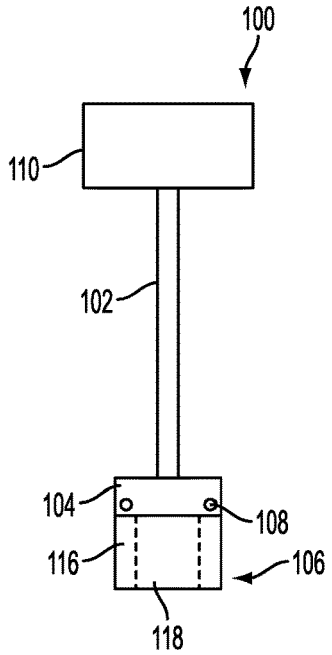
FIG. 1A is a simplified diagram showing a side view of a mixing device with impeller blades in a collapsed arrangement, according to one or more embodiments of the disclosed subject matter.
Figure 1B:
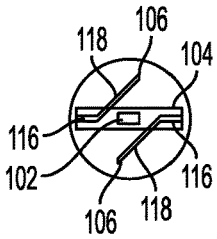
FIG. 1B is a simplified diagram showing a plan view of the impeller blades of FIG. 1A in the collapsed arrangement with respect to a tank opening, according to one or more embodiments of the disclosed subject matter.

Referring to FIGS. 1A-1B, a mixing device 100 is shown in side and plan views, respectively. Mixing device 100 can include a shaft 102 that has an impeller sleeve 104 mounted thereon. Impeller sleeve 104 can have one or more impeller blades 106, for example, two impeller blades 106 as shown in FIGS. 1A-1B. Impeller blades 106 can be held by the impeller sleeve 104 at one or more attachment points, for example, at points 108, which are constructed to allow rotation of blades 106 in the plane of the page. Each blade 106 can include an attachment leg 116, which connects with the attachment point 108, and a stirrer leg 118, which extends from the attachment leg 116 at an angle.

Shaft 102 can be coupled to rotation mechanism 110, which is constructed to rotate the shaft 102, for example, by providing a rotation force to the shaft via a motor, by transmitting a rotation force from an external motor, or by transmitting a manually applied rotation force. The rotation mechanism 110 can be provided with threads or other coupling devices that interface with corresponding devices on the opening 112 or the container 120 to thereby releasably attach the mixing device 100 to the container. For example, the mixing device 100 can be attached to the container 120 for the lifetime of the container 120 and used repeatedly for the mixing of various chemicals. Access to the interior for loading or removal of such chemicals can be obtained by temporarily removing (e.g., unscrewing) the mixing device 100 from the opening 112. Alternatively or additionally, the rotation mechanism 110 may include a separate port through which access may be had to the interior of the container without removal of the mixing device 100.

Figure 3A:
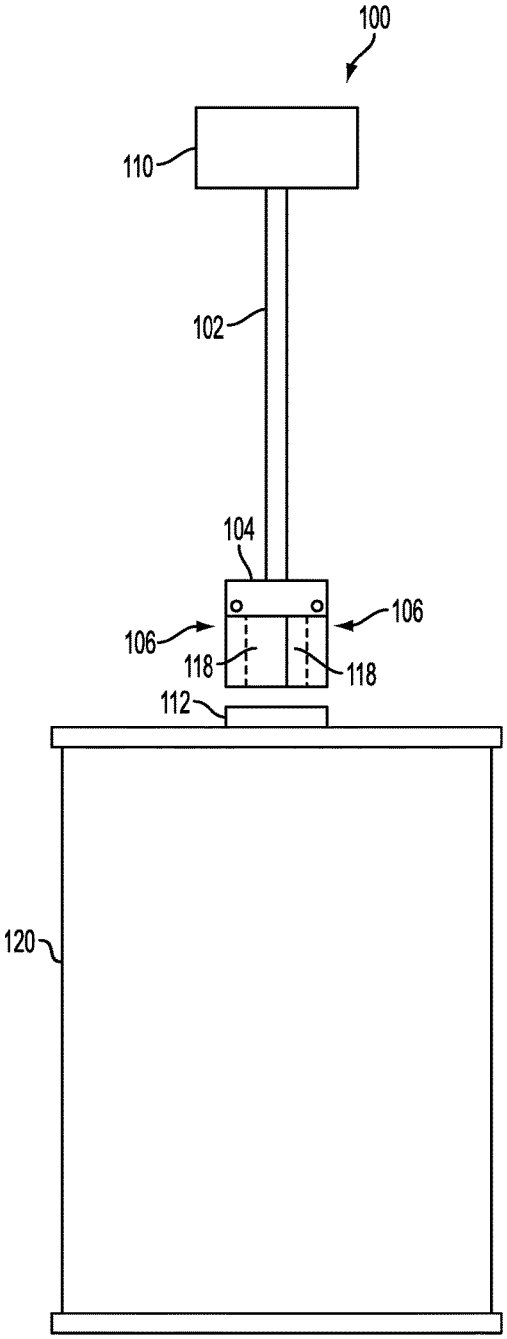
FIGS. 3A-3E show various aspects of insertion and operation of the mixing device in a tank or drum, according to one or more embodiments of the disclosed subject matter.
Figure 3B:
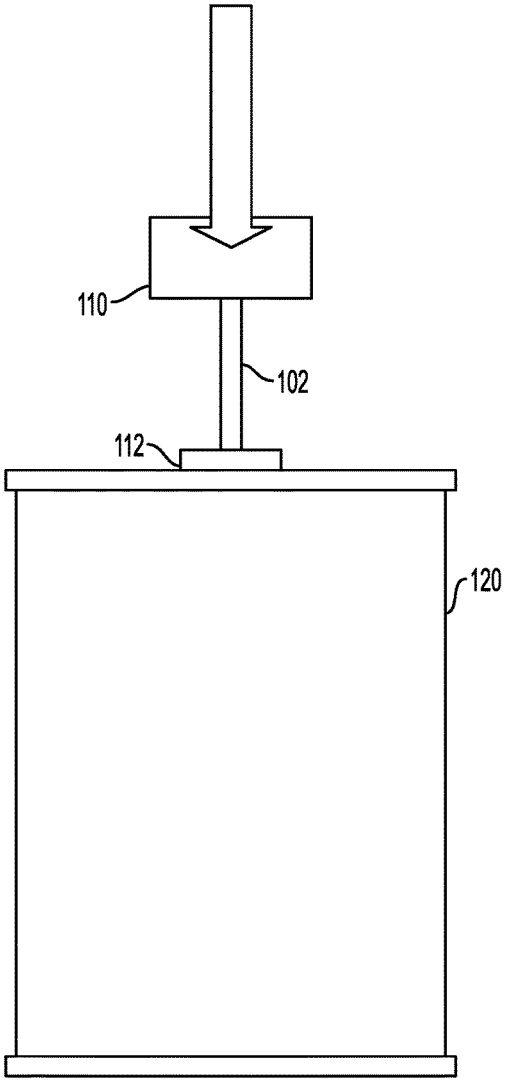
Figure 3C:
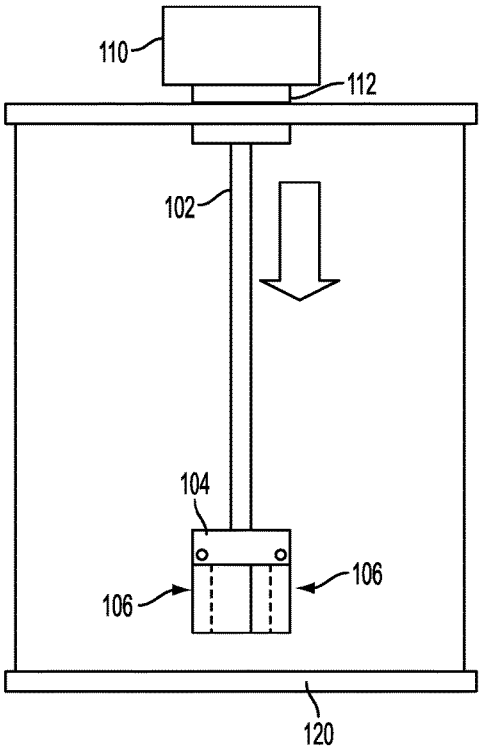
Figure 3D:
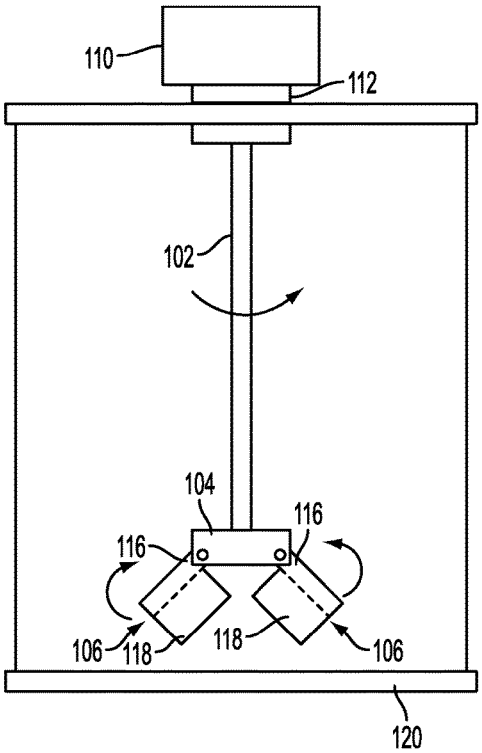
Figure 3E:
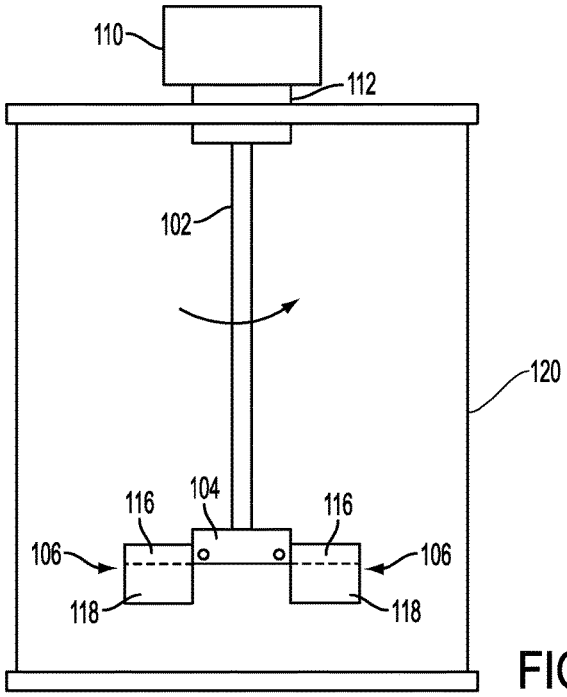

Blades 106 are initially in a collapsed arrangement for insertion through an opening 112 of a container 120, as shown in FIGS. 3A-3B. In the collapsed arrangement, blades 106 have stirrer legs 118 extending in a direction parallel to a rotation axis 114 of the shaft 102, such that the stirrer legs 118 are proximal to the shaft 102, as shown in FIGS. 1A and 1B. However, once fully inserted as in FIG. 3C, the shaft 102 can be rotated. Interaction between the material (e.g., fluid) in the container 120 and/or the force of rotation causes blades 106 to begin to rotate from the collapsed configuration (as shown in FIG. 3D) until fully extended (as shown in FIG. 3E).

Figure 2A:
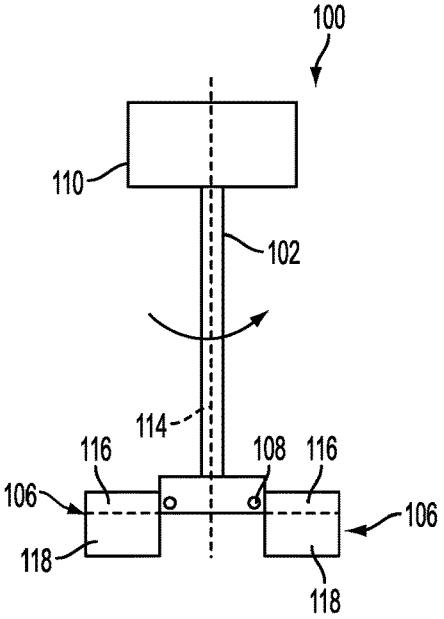
FIG. 2A is a simplified diagram showing a side view of the mixing device of FIGS. 1A-1B with impeller blades in an extended arrangement, according to one or more embodiments of the disclosed subject matter.
Figure 2B:
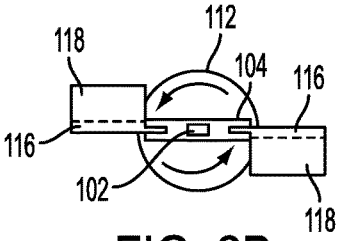
FIG. 2B is a simplified diagram showing a plan view of the impeller blades of FIG. 2A in the extended arrangement with respect to the tank opening, according to one or more embodiments of the disclosed subject matter.
Figure 2C:
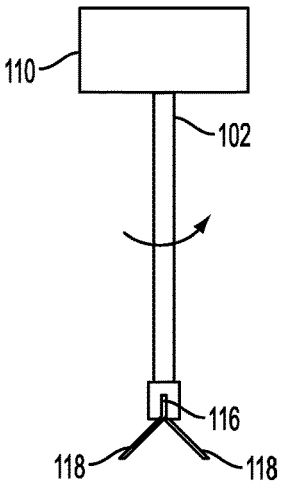
FIG. 2C is a simplified diagram showing another side view of the mixing device of FIG. 2A, according to one or more embodiments of the disclosed subject matter.

Referring to FIGS. 2A-2C, the mixing device 100 with the impeller blades 106 in the fully extended configuration is shown. FIG. 2A shows a side view analogous to that of FIG. 1A, and FIG. 2B shows a plan view analogous to that of FIG. 1B. In the extended arrangement, blades 106 have stirrer legs 118 extending in a direction perpendicular to the rotation axis 114 of the shaft 102, such that the stirrer legs are now distal from the shaft 102, as shown in FIGS. 2A-2B. FIG. 2C is an orthogonal side view of FIG. 2A showing how the stirrer legs 118 are angled with respect to the attachment legs 116. Cessation of rotation of the shaft 102 allows the blades 106 to return to the collapsed state, for example, due to the force of gravity on the blades 106.

Figure 4:
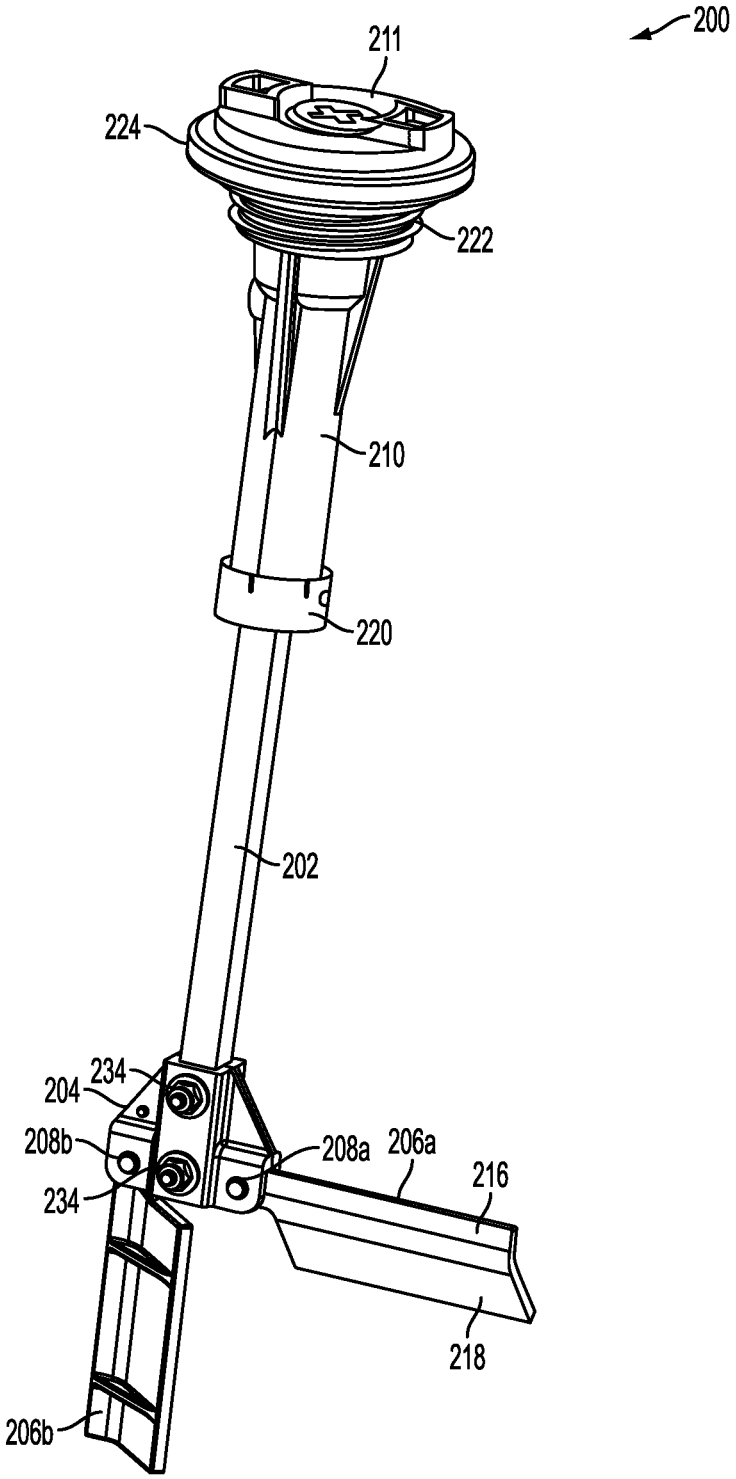
FIG. 4 is a more detailed illustration of a mixing device with a single impeller, where one blade is extended and the other blade is not extended for illustration purposes, according to one or more embodiments of the disclosed subject matter.

Referring to FIGS. 4-8, various components of a mixing device 200 according to one or more embodiments of the disclosed subject matter are shown. FIG. 4 shows an overview of mixing device 200, which includes a shaft 202 coupled to a base 210 at one end thereof and supporting an impeller at an opposite end. The impeller can include an impeller sleeve 204 with a pair of impeller blades 206*a*, 206*b*. Note that one of the impeller blades 206*a* is shown in the extended configuration while the other impeller blade 206*b* is shown in the collapsed configuration.

Figure 5:
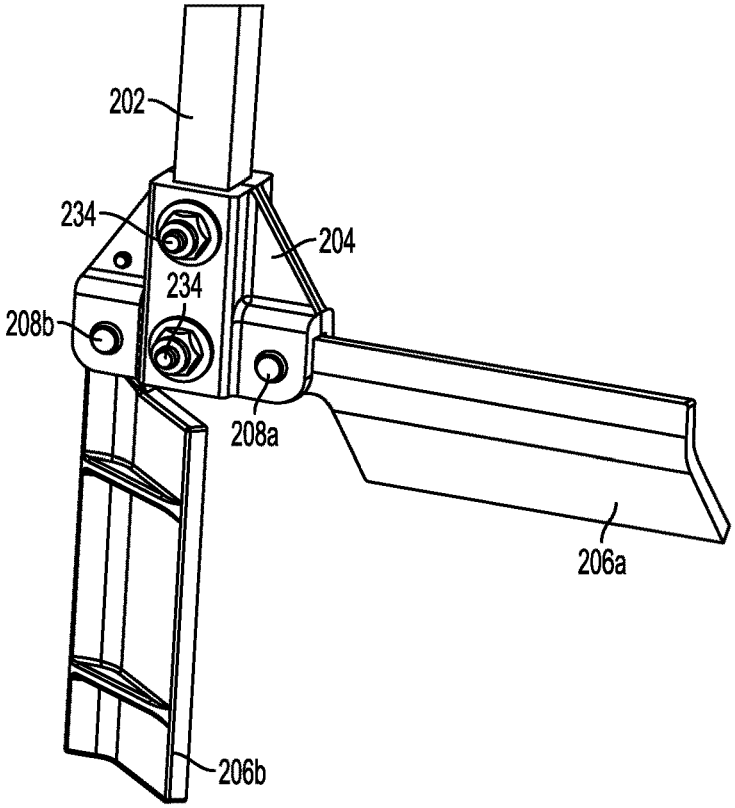
FIG. 5 is a close-up illustration of the impeller portion of the mixing device of FIG. 4, according to one or more embodiments of the disclosed subject matter.
Figure 6A:
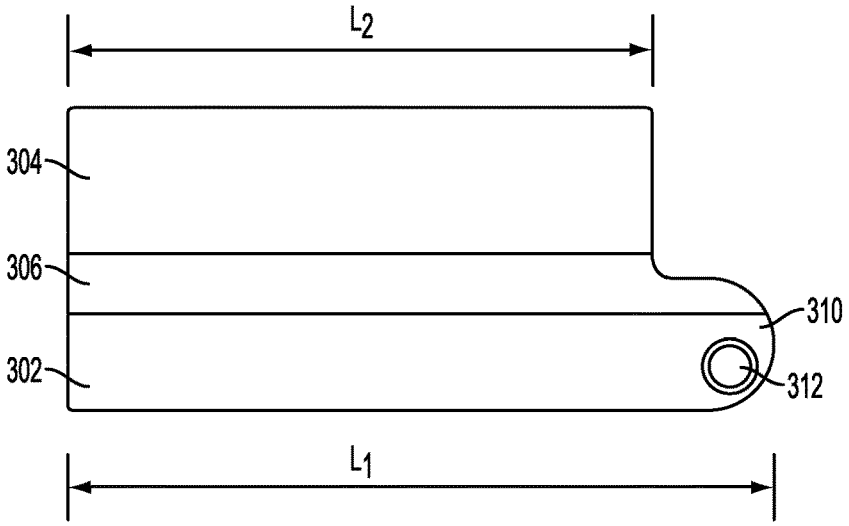
FIG. 6A is an illustration showing a back view of an impeller blade, according to one or more embodiments of the disclosed subject matter.
Figure 6B:
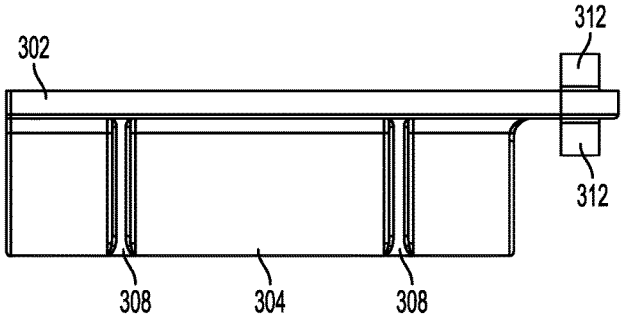
FIG. 6B is an illustration showing a front view of an impeller blade, according to one or more embodiments of the disclosed subject matter.
Figure 6C:
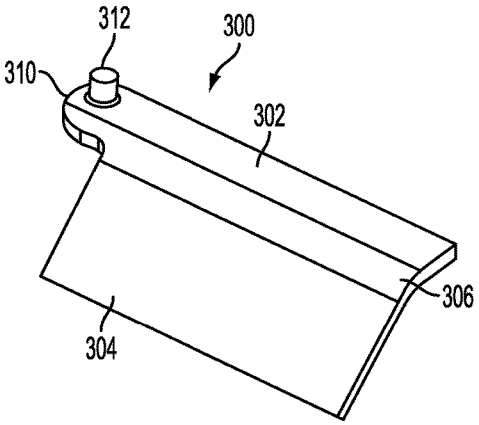
FIGS. 6C-6D are illustrations showing isometric views of an impeller blade, according to one or more embodiments of the disclosed subject matter.
Figure 6D:
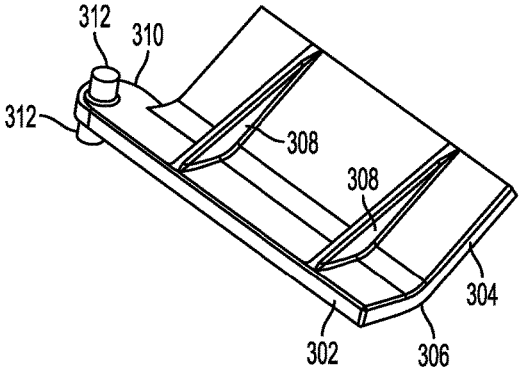
Figure 6E:
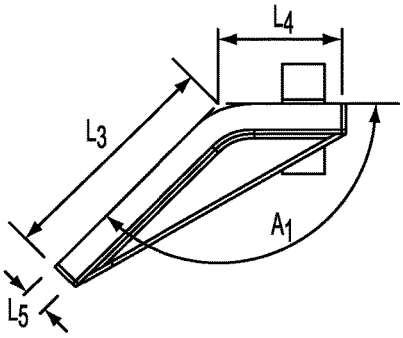
FIGS. 6E-6F is an illustration showing a side view of an impeller blade, according to one or more embodiments of the disclosed subject matter.
Figure 6F:
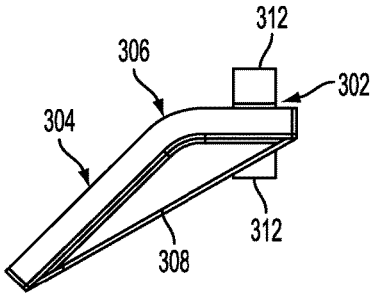

Referring to FIG. 5, a close-up view of the impeller is shown. Impeller sleeve 204 can be secured to the shaft 202 by one or more attachments 234. Attachments 234 can include, but are not limited to, bolts, screws, rivets, epoxy, glue, or welds. Each blade 206*a*, 206*b* is supported at a respective rotation point 208*a*, 208*b* by the impeller sleeve 204. Rotation points 208*a*, 208*b* can include, but are not limited to, bolts, rivets, bearings, or bushings.

Referring to FIGS. 6A-6F, an example of the configuration of an impeller blade, which can serve as impeller blades 106 or 206 in embodiments described above, is shown. The impeller blade can include an attachment leg 302 that include an attachment portion 310 proximal to the impeller sleeve. Extending from the attachment leg 302 at an angle is stirrer leg 304, which is attached to the attachment leg 302 by a transition portion 306, for example, a bend or a chamfer region.

The attachment portion 310 can include, for example, one or more bushings 312 extending from a surface of the attachment portion 310 and interfacing with a corresponding opening or recess on the impeller sleeve. The bushing 312 can rotatably fit within the opening or recess to thereby allow the blade to freely rotate between collapsed and extended positions. The bushings 312 can extend from one or both sides of the attachment portion 310. Alternatively, a hole or recess can be provided in the attachment portion 310 to receive a corresponding bushing of the impeller sleeve. In still another alternative, a hole or recess can be provided in the attachment portion 310 to receive a bolt, bearing, rivet, or any other attachment mechanism that would allow displacement of the blade between collapsed and extended positions.

In embodiments, the impeller blade can comprise a plastic material, for example, a polypropylene (e.g., glass-filled polypropylene, such as 30% glass-filled polypropylene or 60% glass-filled polypropylene) or a nylon material (e.g., glass-filled nylon, such as 70% glass-filled nylon). Other materials for the impeller blade are also possible according to one or more contemplated embodiments.

Figure 23A:
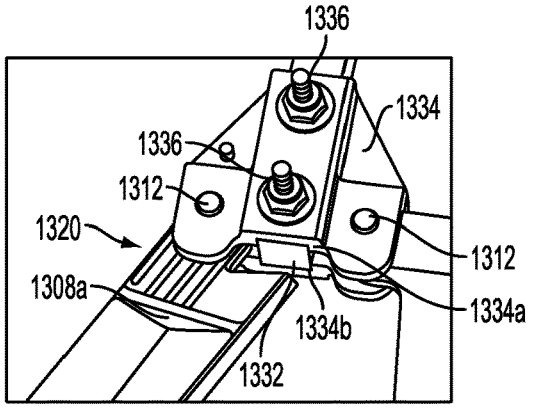
FIG. 23A is a close-up illustration of the impeller blade of FIG. 22 held to a shaft by an impeller sleeve, according to one or more embodiments of the disclosed subject matter.
Figure 23B:
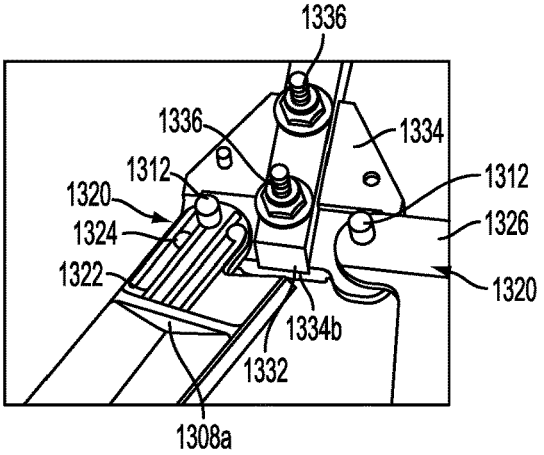
FIG. 23B is a close-up illustration of the arrangement of FIG. 23A with a portion of the impeller sleeve removed, according to one or more embodiments of the disclosed subject matter.

In embodiments, features can be added to improve the structural rigidity of the blade. For example, one or more support ribs or struts 308 can extend between a face of stirrer leg 304 and a face of attachment leg 302. The ribs 308 can be provided at regular intervals along the length of the blade or positioned evenly with respect to a center of the stirrer leg face 304, as shown, for example, in FIG. 6B. Other features for increasing the strength of the impeller blade are also possible according to one or more contemplated embodiments. For example, regions of the blade subject to higher stress concentrations may be reinforced with stronger materials, made of increased thickness, or include an array of ribs (e.g., as discussed below with respect to FIGS. 22-24).

In embodiments, the impeller blade can have a stirrer leg 304 with a length ($L_2$) of approximately 3.3 inches and an attachment leg 302 (including attachment portion 310) with a length ($L_1$) of approximately 4 inches. The thickness ($L_5$) of the stirrer leg 304 can be 0.18 inches, which may have the same thickness as the attachment leg 302 and attachment portion 310. Each support rib can have a width of 0.125 inches and can have an outer edge that forms an angle of 15° with respect to a surface of the stirrer leg 304. The outer surface of the stirrer leg 304 can form an angle ($A_1$) of 135° or less with respect to an outer surface of the attachment leg 302. The stirrer leg 304 can have a width in cross-section ($L_3$) that is related to the width in cross-section ($L_4$) of the attachment leg 302. In particular, a ratio of stirrer leg width to attachment leg width ($L_3$:$L_4$) can be at least 1.8:1. For example, the width of the stirrer leg in cross-section ($L_3$) can be 1.375 inches, while the width of the attachment leg in cross-section ($L_4$) can be 0.75 inches. The above-noted dimensions are intended to be exemplary only, and other dimensions are also possible according to one or more contemplated embodiments.

Figure 7:
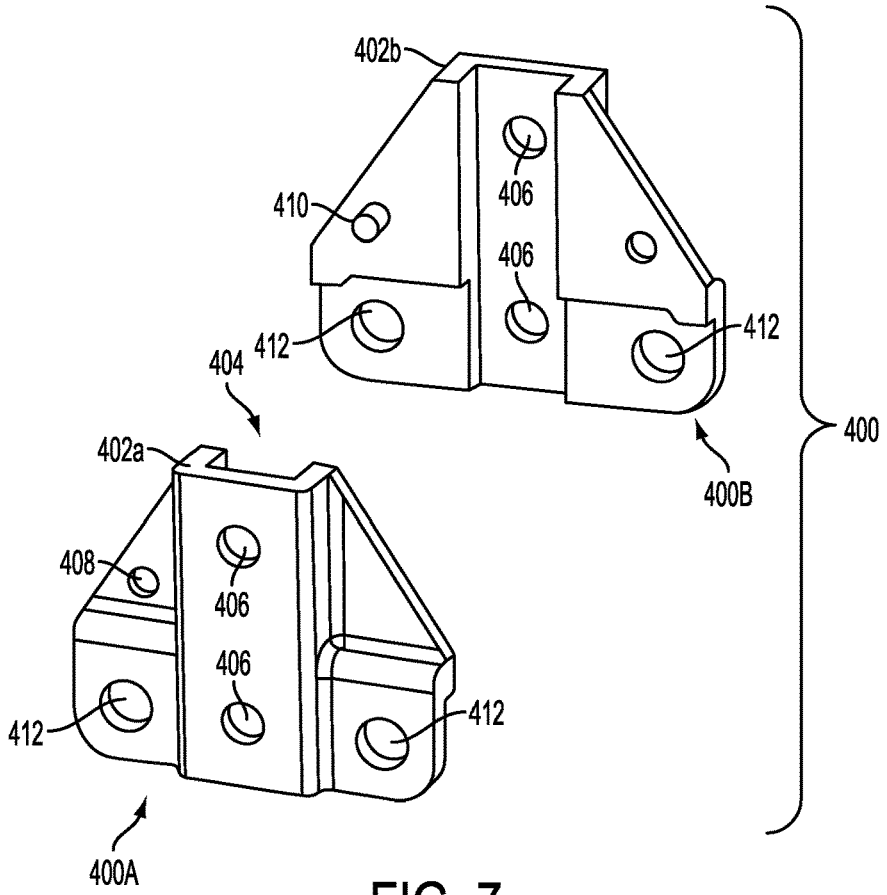
FIG. 7 is an illustration showing an isometric view of a disassembled impeller sleeve, according to one or more embodiments of the disclosed subject matter.

Referring to FIG. 7, an example of the configuration of an impeller sleeve 400, which can serve as impeller sleeve 104 or 204 in embodiments described above, is shown. The impeller sleeve 400 can include a front half 400A and a back half 400B, each of which has a protrusion forming a generally U-shaped channel 402*a*, 402*b*. When the halves 400A, 400B are joined together, the U-shaped channels 402*a*, 402*b* align to form a generally rectangular channel 404 that holds the shaft of the mixing device, for example, shaft 102 or 202. One or more holes 406 can be provided for securing the respective halves 400A, 400B to the shaft and/or to each other. For example, as illustrated in FIGS. 4-5, a bolt may be passed through each hole 406 to secure the halves 400A, 400B to the shaft and to each other. While a rectangular geometry for the shaft and the channel 404 have been illustrated, other geometries are also possible, such as circular, elliptical, triangular, polygonal, or any other cross-sectional shape.

Each half of the sleeve can also be provided with one or more features for alignment. For example, a protrusion 410 can be provided on back half 400B, which fits into a corresponding opening 408 on the front half 400A. Additional alignment features can also be provided. Each half 400A, 400B can also include an opening or recess constructed to receive a protrusion (e.g., bushing 312 as shown in FIGS. 6A-6E) of the impeller blade. When the halves 400A, 400B are joined together, the protrusion fits into opening 412 and thereby secures the impeller blade to the impeller sleeve. The openings 412 may be constructed such that the protrusion can freely rotate therein, thereby allowing the impeller blade to move between collapsed and extended configurations. Although circular holes are illustrated in FIG. 7 for receiving bushing 312 of the impeller blade, embodiments of the disclosed subject matter are not limited thereto. For example, an elongated slot may be used to allow translation of the impeller blade, for example, radially away from the shaft or axially along the shaft, in place of or in conjunction with the rotation of the blade into an extended position.

Figure 8:
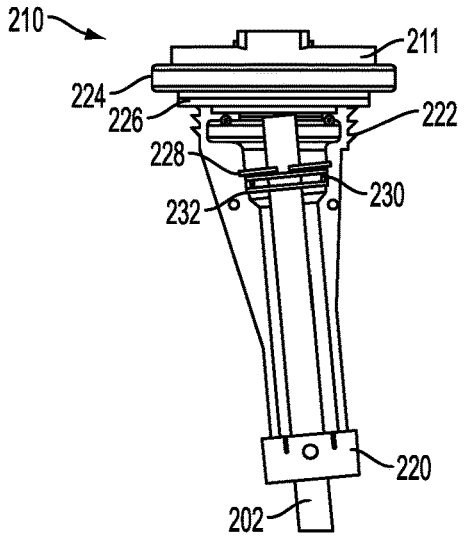
FIG. 8 is an illustration showing a cross-sectional view of a base of the mixing device of FIG. 4, according to one or more embodiments of the disclosed subject matter.

Referring to FIG. 8, a close-up view of the base 210 is shown. Base 210 can be coupled to the shaft 202 at a top end thereof, for example, adjacent a base cap 220. The base 210 can include a top cap 211, which may have a connection for attachment to a rotation source, such as a motor or manual lever. Alternatively or additionally, cap 211 may be removable to allow access to a connection for attachment to a rotation source. The base 210 can have a top ring 224 that sits over an O-ring 226, which may be used to seal the base 210 to an opening of the container. Opening interface 222, for example, threads, may be used to releasably attach the base 210 to the opening, for example, by screwing the base into the opening. Retaining ring 228, roll pin 230, and shaft ring 232, which are internal to the base 210, can provide stability during torque transmission between a rotation source and the shaft 202.

Figure 9:
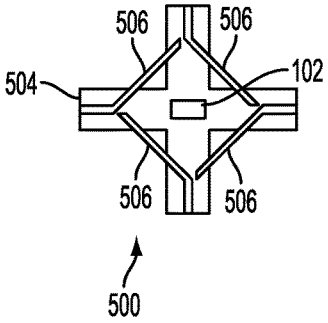
FIG. 9 is a simplified diagram showing a plan view of impeller blades of a mixing device in a collapsed arrangement, according to one or more embodiments of the disclosed subject matter.
Figure 10:
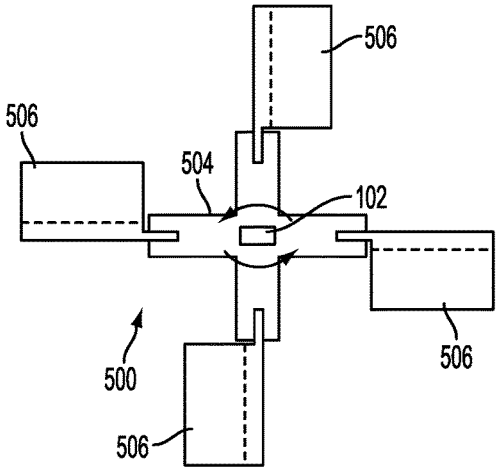
FIG. 10 is a simplified diagram showing a plan view of the impeller blades of FIG. 9 in an extended arrangement, according to one or more embodiments of the disclosed subject matter.

Although embodiments have been described with respect to a pair of impeller blades for a single impeller sleeve, other numbers of impeller blades and impellers are also possible according to one or more contemplated embodiments. For example, FIGS. 9-10 illustrate a mixing device 500 that has a single impeller sleeve 504 with four impeller blades 506. In the collapsed configuration of FIG. 9, the stirrer leg of each blade 506 is arranged proximal to the shaft 102, such that in plan view the stirrer legs follow a rectangular geometry, while the attachment legs are parallel to the cross-shape formed by the impeller sleeve 504. In the extended configuration of FIG. 10, the stirrer leg of each blade 506 has been rotated away from the shaft 102, such that the impeller has a windmill like shape in plan view. The side view of the mixing device would be a combination of the views illustrated in FIGS. 2A, 2C.

Figure 11:
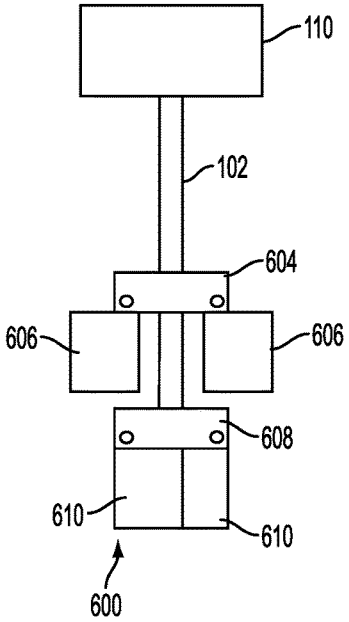
FIG. 11 is a simplified diagram showing a side view of a mixing device with multiple impellers and blades in a collapsed arrangement, according to one or more embodiments of the disclosed subject matter.
Figure 12:
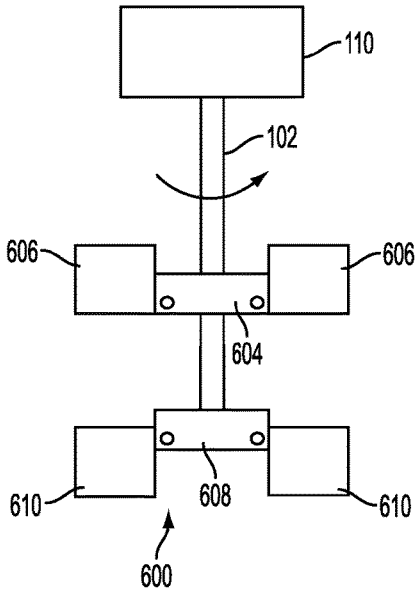
FIG. 12 is a simplified diagram showing a side of the mixing device of FIG. 11 with impeller blades in an extended arrangement, according to one or more embodiments of the disclosed subject matter.

In another example, a mixing device 600 can include multiple impeller sleeves with two impeller blades per sleeve. Thus, as shown in FIGS. 11-12, a first impeller sleeve 604 can include a pair of impeller blades 606 while a second impeller sleeve 608 can include a pair of impeller blades 610. The second impeller sleeve 608 and the pair of impeller blades 610 can be similar to those described with respect to FIGS. 1A-2C. However, since the first impeller sleeve 604 is arranged away from the end of the shaft 102, the blades 602 may have a different arrangement to avoid potential interference with the shaft 102. While blades 610 are arranged such that the stirrer legs overlap the shaft 102 in the side view, as shown in the collapsed configuration of FIG. 11, the stirrer legs of blades 606 are arranged so as to not overlap the shaft 102 in the side view. When the shaft 102 is rotated, the blades 606 and 610 rotate with respect to sleeves 604 and 608 respectively, to achieve the extended configuration, as shown in FIG. 12. It is noted that since impeller blades 606 are displaced radially outward from the shaft, the size of the opening through which the mixing device is inserted must be correspondingly larger than would otherwise be necessary with just impeller sleeve 608 and impeller blades 610.

Figure 13:
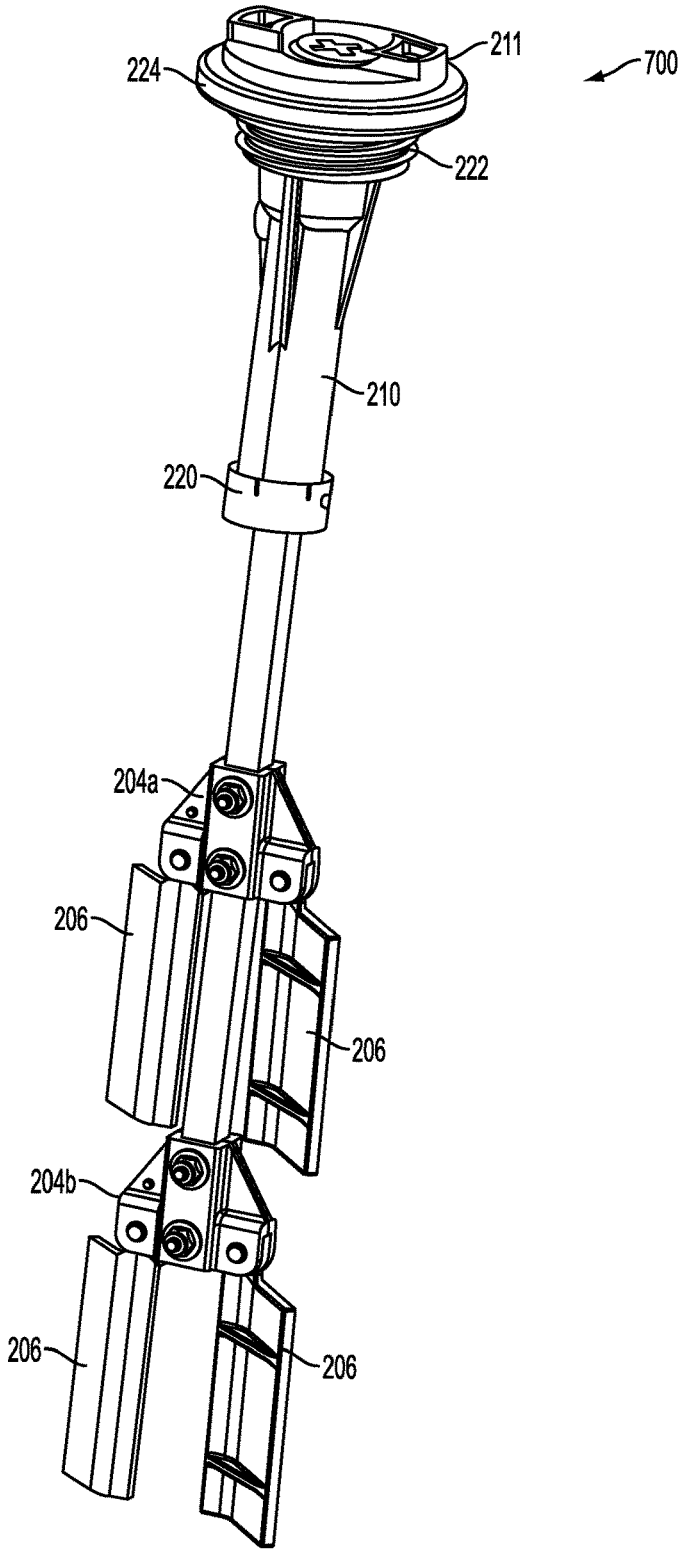
FIG. 13 is a more detailed illustration of a mixing device with a dual impeller in a collapsed arrangement, according to one or more embodiments of the disclosed subject matter.

In another example, a mixing device 700 can include multiple impeller sleeves, each of which has blades spaced radially outward from the shaft, as shown in the collapsed configuration of FIG. 13. Thus, the first impeller sleeve 204*a* has impeller blades 206 displaced radially outward such that the blades do not overlap the shaft in the side view. The second impeller sleeve 204 also has impeller blades 206 displaced radially outward such that the blades do not overlap the shaft in the side view. Since both the first and second impeller sleeves have the same arrangement, standardization in manufacturing and assembly may be achieved.

Figure 14:
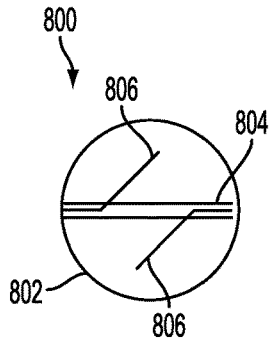
FIG. 14 is a simplified diagram showing a plan view of impeller blades in a collapsed arrangement with respect to a tank opening, according to one or more embodiments of the disclosed subject matter.
Figure 15:
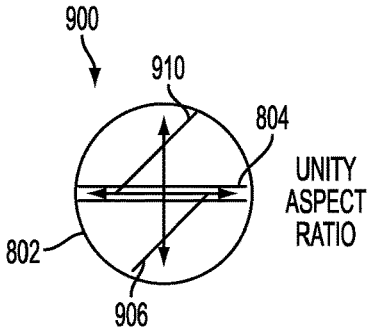
FIG. 15 is a simplified diagram showing a plan view of other impeller blades in a collapsed arrangement with respect to a tank opening, according to one or more embodiments of the disclosed subject matter.

In embodiments, the impeller blades can be sized and shaped such that they can fit through a reduced-size opening of the barrel or container with extended clearance, for example, to allow flexibility when coupling to the mixing assembly to the container. For example, FIG. 14 shows a mixing assembly configuration 800, where impeller blades 806 are sized and shaped such that a width within container opening 802, as defined by the mounting of blades on sleeve 804, is less than a height of the blades within container opening 802 (i.e., having an aspect ratio in the collapsed arrangement less than 1). Alternatively, the impeller blades can be sized and shaped such that they have reduced or a minimum clearance as they pass through opening 802. For example, FIG. 15 shows a unity aspect ratio mixing assembly configuration 900, where impeller blades 906 have a longer stirring portion 910 as compared to impeller blades 806.

Figure 16:
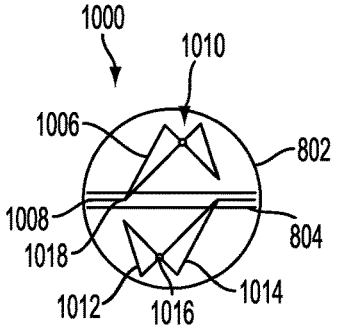
FIG. 16 is a simplified diagram showing a plan view of impeller blades with a living hinge in a collapsed arrangement with respect to a tank opening, according to one or more embodiments of the disclosed subject matter.
Figure 17:
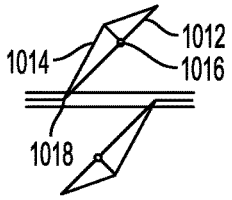
FIG. 17 is a simplified diagram showing a plan view of the impeller blades of FIG. 16 in an extended arrangement, according to one or more embodiments of the disclosed subject matter.

Although plastic bushings within an impeller sleeve have been described for allowing impeller blades to transition from the collapsed to the extended arrangement, other mechanisms for allowing extension of the impeller blades are also possible according to one or more contemplated embodiments. For example, the use of plastic impeller blades can allow the extension mechanism to be incorporated into the blade itself, as illustrated in FIGS. 16-17. A mixing assembly 1000 is shown in a collapsed arrangement in FIG. 16 and in an extended arrangement in FIG. 17. Each impeller blade 1006 includes an attachment portion 1008 that holds the stirring portion 1010 of the blade 1006 (via a rigid connection 1018) to an impeller sleeve 804. The stirring portion 1010 includes leading section 1012 and a middle section 1014 joined together by a flexible joint 1016, which may be, for example, a living hinge. During insertion into opening 802, the blades 1006 are naturally in a collapsed arrangement (for example, molded in such a configuration). However, after insertion and by virtue of the force on the blades 1006 during stirring, the leading section 1012 can rotate about joint 1016 until an enlarged portion thereof abuts with a corresponding portion of middle section 1014, thereby providing a more rigid stirring portion 1010 in the extended arrangement of FIG. 17. The natural resiliency of the plastic material can allow the blade 1006 to return to the collapsed arrangement upon cessation of stirring.

Figure 18:
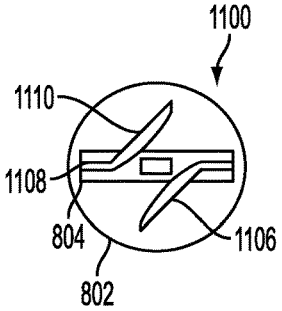
FIG. 18 is a simplified diagram showing a plan view of impeller blades with a curved configuration in a collapsed arrangement with respect to a tank opening, according to one or more embodiments of the disclosed subject matter.
Figure 19:
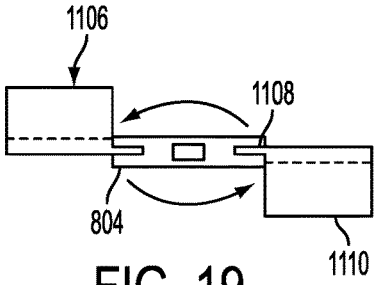
FIG. 19 is a simplified diagram showing a plan view of the impeller blades of FIG. 18 in an extended arrangement, according to one or more embodiments of the disclosed subject matter.
Figure 20:
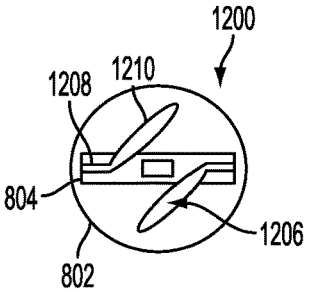
FIG. 20 is a simplified diagram showing a plan view of propeller-shaped impeller blades in a collapsed arrangement with respect to a tank opening, according to one or more embodiments of the disclosed subject matter.
Figure 21:
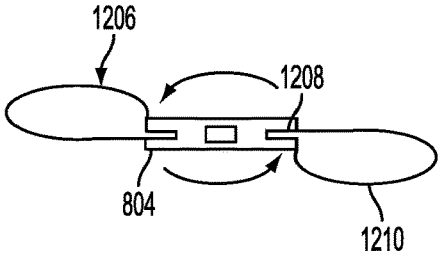
FIG. 21 is a simplified diagram showing a plan view of the impeller blades in an extended arrangement, according to one or more embodiments of the disclosed subject matter.
Figure 22A:
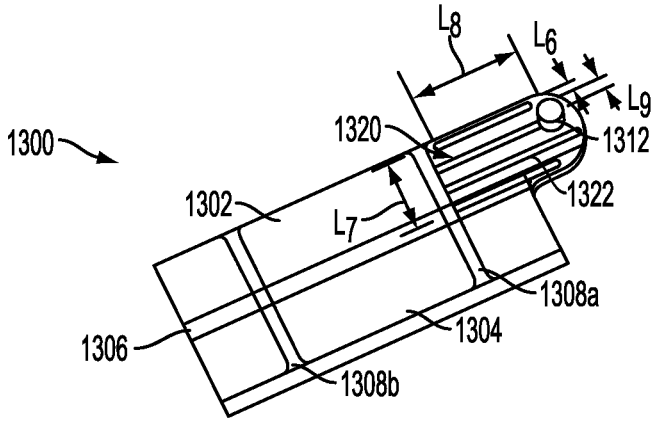
FIGS. 22A-22D are illustrations showing an impeller blade with a ribbed attachment portion from various views, according to one or more embodiments of the disclosed subject matter.
Figure 22B:
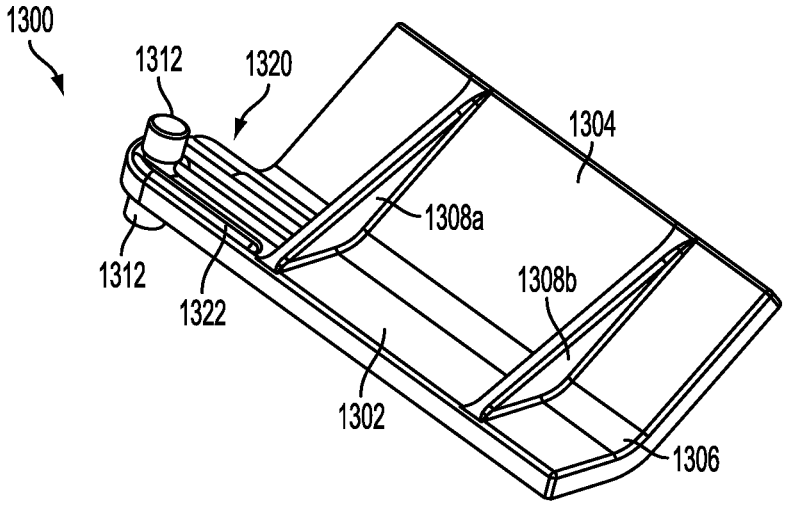
Figure 22C:
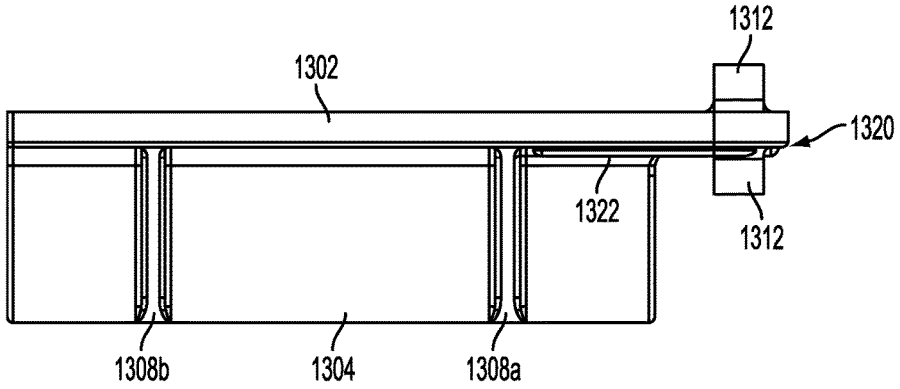
Figure 22D:
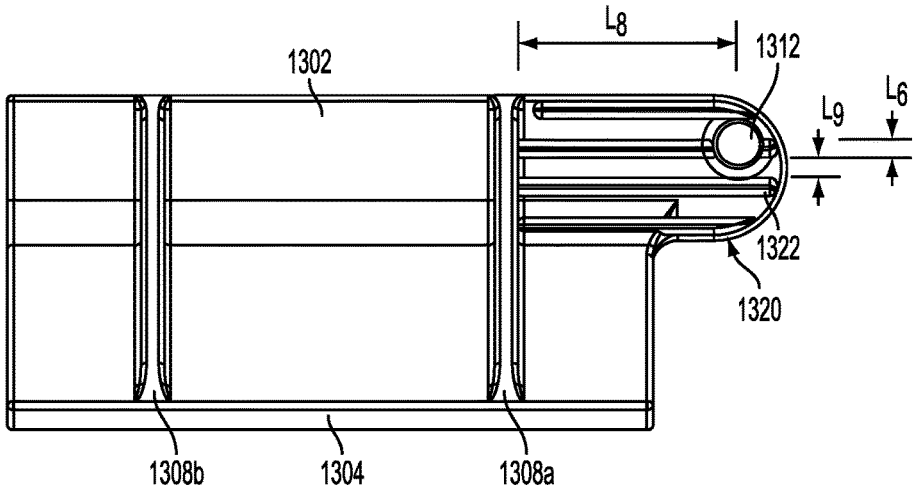

In addition, although particular blade shapes have been illustrated in the above described embodiments, other impeller blade shapes are also possible according to one or more contemplated embodiments. For example, FIGS. 18-19 show a mixing assembly 1100 having curved impeller blades 1106 in collapsed and extended arrangements, respectively. In particular, each impeller blade 1106 can have an attachment leg 1108 coupled to a stirring leg 1110, which may be curved rather than angled. In an alternative example, the impeller blades can be propeller-shaped, for example, as a folding propeller, as shown in FIGS. 20-21. Mixing assembly 1200 thus has a blade 1206 with a propeller-shaped stirring leg 1210 connected to impeller sleeve 804 by an attachment leg 1208. The stirring leg 1210 can be shaped, for example, as a twisted airfoil, a curved scimitar, or as any other shape capable of mixing within the container.

In embodiments, portions of each impeller blade can include reinforcing structures to strengthen the blade, for example, at portions of the blade that attach to the impeller sleeve (e.g., attachment portion 310). Such reinforcing structures can take the form of, for example, a region having an increased thickness, a region formed from a different, higher strength material, a separate piece of higher strength material attached to the region of the impeller blade, and/or one or more ribs on one or more surfaces of the region of the impeller blade. For example, at least a first region of the attachment leg proximal to the impeller sleeve and/or surrounding the bushing can have a thickness greater than that of the rest of (or at least other regions) of the attachment leg.

In another example, a region of an impeller blade 1300 can include a plurality of ribs 1322, as illustrated in FIGS. 22A-23B. As with other embodiments, the impeller blade 1300 can include an attachment leg 1302 that includes an attachment portion 1320 proximal to the impeller sleeve 1334, which has a front half 1334*a* and a back half 1334*b*. The impeller sleeve 1334 attaches to shaft 1332 via one or more attachments 1336 (e.g., bolts, screws, rivets, welds, etc.). Extending from the attachment leg 1302 at an angle is a stirrer leg 1304, which is attached to the attachment leg 1302 by a transition portion 1306, for example, a bend or a chamfer region. The attachment leg 1302 can extend along a direction of extension or elongation, i.e., from a first end where the bushing 1312 is located and proximal to the impeller sleeve to a second end opposite the first end and distal from the impeller sleeve. In a direction transverse to the elongation direction, the attachment leg 1302 and the stirrer leg 1304 can be disposed adjacent to each other, with the transition portion 1306 therebetween.

One or more support ribs or struts 1308*a*, 1308*b* can extend between a face of stirrer leg 1304 and attachment leg 1302, with a first strut 1308*a* disposed proximal to the impeller sleeve 1334 and a second strut 1308*b* disposed distal from the impeller sleeve 1334. Each support rib 1308*a*, 1308*b* can extend along the transverse direction to connect an outer edge of attachment leg 1302 to an outer edge of the stirrer leg 1304.

The region of the impeller blade 1300 that includes ribs 1322 can be proximal to the impeller sleeve 1334 so as to reinforce the impeller blade 1300 at its point of attachment, i.e., bushing 1312 that interfaces with an opening or recess in the impeller sleeve 1134. The ribbed region may cover, for example, the attachment portion 1320 of the attachment leg 1302. The attachment portion 1320 comprising ribs 1322 can be bounded by one of the support ribs 1308*a* proximal to the impeller sleeve 1334, such that the ribs 1322 do not extend past the support rib 1308*a*. In other contemplated configurations, the ribs 1322 may extend beyond support rib 1308*a* or even the entire length of the attachment leg 1302.

Each rib 1322 can extend longitudinally, i.e., along the elongation direction of the attachment leg 1302, which may be perpendicular to, or at least crossing, a direction of extension of support rib 1308*a*. In some embodiments, each rib extends parallel to the elongation direction, whereas in other embodiments, each rib extends mainly along (e.g., at an angle less than 10° with respect to) the elongation direction. Although ribs 1322 are illustrated on only a single side of attachment portion 1320 in FIGS. 22A-23B, it is contemplated that ribs 1322 can be provided on either or both sides of attachment portion 1320.

For example, when the attachment leg 1302 has a length of 4 inches and a thickness of 0.18 inches, each rib 1322 can have a width ($L_6$) of approximately 0.09 inches, a height (from the surface of the attachment portion 1320) of approximately 0.045 inches, and a spacing ($L_9$) from adjacent ribs of at least 0.11 inches. A maximum length of each rib 1322 may be defined by the length of the attachment portion 1320, which may be approximately 1.438 inches. Alternatively, a length of some of the ribs 1322 may be defined by a distance from a center of bushing 1312, for example, where one end is disposed at a distance ($L_8$) of approximately 1.05 inches from the bushing center. The width ($L_7$) of the attachment portion 1320 may be the same or different as the width of the attachment leg 1302. For example, when the width of the attachment leg is 0.75 inches, the width ($L_7$) of the attachment portion 1320 can be approximately 0.75 inches. The spacing, sizes, and number of the ribs 1322 can be selected to cover a particular portion of the attachment portion 1320, for example, such that at least 40% of the available surface area (with or without bushing 1312) on one side of the attachment portion 1320 is covered by the ribs 1322. The above-noted dimensions are intended to be exemplary only, and other dimensions are also possible according to one or more contemplated embodiments.

Within the attachment portion 1320 one or more manufacturing features may be provided, for example surface 1324. During manufacturing of the impeller blade, an eject pin can press against surface 1324 in order to eject the impeller blade from the mold. Different configurations and locations for surface 1324 are also possible according to one or more contemplated embodiments.

Figure 24:
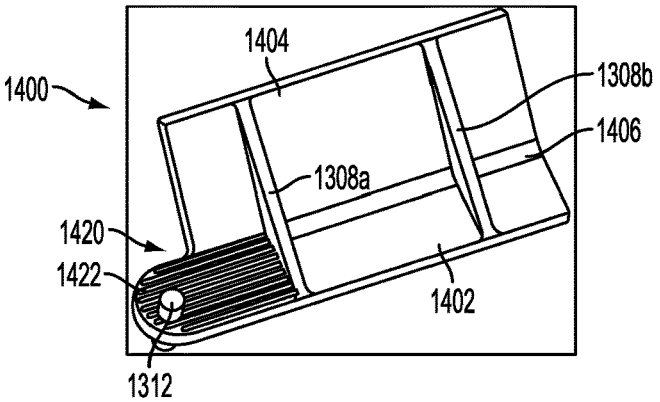
FIG. 24 is an illustration showing another impeller blade with a ribbed attachment portion, according to one or more embodiments of the disclosed subject matter.

Although only four ribs are illustrated in FIGS. 22A-22D, the numbers and sizes of ribs are not limited thereto. Rather, FIG. 24 shows an embodiment of an impeller blade 1400 having an attachment leg 1402, transition portion 1406, and stirrer leg 1404, where the attachment portion 1420 has nine ribs 1422 that are thinner and more tightly spaced than the embodiment illustrated in FIGS. 22A-22D. For example, when the attachment leg 1402 has a length of 4 inches and a thickness of 0.18 inches, each rib 1422 can have a width of approximately 0.045 inches, a height (from the surface of the attachment portion 1420) of approximately 0.045 inches, and a spacing from adjacent ribs of at least 0.040 inches. A maximum length of each rib 1422 may be defined by the length of the attachment portion 1420, which may be approximately 1.438 inches. The width of the attachment portion 1420 may be the same or different as the width of the attachment leg 1402. For example, when the width of the attachment leg is 0.75 inches, the width of the attachment portion 1420 can be approximately 0.75 inches. The spacing, sizes, and number of the ribs 1422 can be selected to cover a particular portion of the attachment portion 1420, for example, such that at least 50% of the available surface area (with or without the bushing) on one side of the attachment portion 1420 is covered by the ribs 1422. The above-noted dimensions are intended to be exemplary only, and other dimensions are also possible according to one or more contemplated embodiments.

Various sizes and configurations for the ribs other than those illustrated in FIGS. 22A-24 are also possible according to one or more embodiments of the disclosed subject matter. For example, the ribs may form a checkerboard pattern, with a first set of ribs extending mainly along the elongation direction and a second set of ribs extending in a direction transverse to the elongation direction. In another example, the ribs may be substantially annular rings or arcs centered at the bushing 1312. In still another example, the ribs may be disposed as a non-regular array, with the spacing between adjacent ribs varied in accordance with strength requirements of the mixing application. For example, ribs closer to bushing 1312 may have increased widths or thickness and/or tighter spacing whereas ribs farther from bushing 1312 may have decreased widths or thicknesses and/or wider spacing.

Advantageous mixing of substances, such as, but not limited to, heterogeneous mixtures, prone to separation of component ingredients, can be achieved by virtue of the disclosed impeller blade geometries and configurations. In particular, embodiments of the disclosed mixing device can be applied to mixing seed treatment products in 5 gallon, 15 gallon, 30 gallon, or 55 gallon drums, as well as other mixing applications.

In one or more first embodiments, a mixing device comprises a base, a shaft, a first impeller sleeve and at least one first impeller blade. The base is constructed to be releasably attached to an opening of a container. The shaft extends from the base and is coupled thereto such that rotation is transmitted to the shaft by way of or through the base. The first impeller sleeve is mounted on the shaft. The at least one first impeller blade comprises an attachment leg and a stirring leg extending from the attachment leg. Each first impeller blade is supported by the first impeller sleeve so as to transition from a collapsed position with the stirring leg proximal to a central axis of the shaft to an extended position with the stirring leg distal from the central axis when the shaft is rotated. Each first impeller blade comprises a plastic material.

In the first embodiments or any other of the disclosed embodiments, the stirring leg extends at an angle from the attachment leg, the angle being 135° or less.

In the first embodiments or any other of the disclosed embodiments, in the collapsed position, a ratio of a length of the stirring leg in plan view to a length of the attachment leg in plan view is at least 1.8:1.

In the first embodiments or any other of the disclosed embodiments, each first impeller blade comprises glass-filled polypropylene or glass-filled nylon.

In the first embodiments or any other of the disclosed embodiments, each first impeller blade includes at least one support rib extending from a face of the stirring leg.

In the first embodiments or any other of the disclosed embodiments, the at least one first impeller blade comprises two first impeller blades.

In the first embodiments or any other of the disclosed embodiments, the mixing further comprises a second impeller sleeve and at least one second impeller blade. The second impeller sleeve is mounted on the shaft between the base and the first impeller sleeve. The at least one second impeller blade is supported by the second impeller sleeve.

In the first embodiments or any other of the disclosed embodiments, the second impeller sleeve and the at least one second impeller blade are constructed such that a stirring leg of each second impeller blade does not overlap the second impeller sleeve in plan view. The first impeller sleeve and the at least one first impeller blade are also constructed such that the stirring leg of each first impeller blade does overlap the first impeller sleeve in the plan view.

In the first embodiments or any other of the disclosed embodiments, the attachment leg of each first impeller blade includes an attachment portion with a bushing extending from a surface thereof, the first impeller sleeve includes a hole or recess that receives said bushing, and the hole or recess and the bushing are constructed to allow the corresponding first impeller blade to rotate from the collapsed position to the extended position.

In the first embodiments or any other of the disclosed embodiments, the attachment leg of each first impeller blade includes an attachment portion with a pair of bushings extending from opposite surfaces thereof, the first impeller sleeve includes corresponding holes or recesses that receive the bushings, and the holes or recesses and the bushings are constructed to allow the corresponding first impeller blade to rotate from the collapsed position to the extended position.

In the first embodiments or any other of the disclosed embodiments, the base includes a motor that provides a rotational force to the shaft or is constructed to transmit a rotational force from a motor to the shaft.

In the first embodiments or any other of the disclosed embodiments, each first impeller blade includes a living hinge that allows it to transition to the extended position, the living hinge connecting the attachment leg to the stirring leg or comprising part of the stirring leg.

In the first embodiments or any other of the disclosed embodiments, each first impeller blade has a curved surface or is propeller-shaped.

In the first embodiments or any other of the disclosed embodiments, at least a first region of the attachment leg of each first impeller blade has a plurality of ribs, the first region being proximal to the first impeller sleeve.

In the first embodiments or any other of the disclosed embodiments, each of the plurality of ribs extend longitudinally in a direction of elongation of the first impeller blade.

In the first embodiments or any other of the disclosed embodiments, a support rib extends along a first direction between a face of the stirring leg and a face of the attachment leg, each of the plurality of ribs extends along a second direction perpendicular to or at least crossing the first direction, and the support rib bounds the first region.

In the first embodiments or any other of the disclosed embodiments, each rib has a height of at least 0.045 inches, and a number, size, and spacing of the plurality of ribs is such that at least 40% of the area in the first region is covered by the ribs.

In the first embodiments or any other of the disclosed embodiments, the first region is an attachment portion with at least one bushing protruding from at least one surface thereof, the at least one surface including the plurality of ribs.

In the first embodiments or any other of the disclosed embodiments, at least a first region of the attachment leg of each first impeller blade has a thickness greater than that of other regions of the attachment leg, the first region being proximal to the first impeller sleeve.

In one or more second embodiments, a mixing device comprises a base, a shaft, and an impeller. The base is constructed to be releasably attached to an opening of a container. The shaft is coupled to the base. The impeller is mounted on the shaft and comprises at least two plastic blades constructed to displace from a collapsed position to an extended position upon rotation of the shaft. Each blade has a first leg and a second leg in cross-section joined together at adjacent edges and at least one support rib extending between the first and second legs. An end of the first leg is coupled to the impeller. An angle between the first and second legs is 135° or less, and a length of the second leg to a length of the first leg is at least 1.8:1.

In the second embodiments or any other of the disclosed embodiments, the at least two plastic blades is at least four plastic blades.

In the second embodiments or any other of the disclosed embodiments, each plastic blade comprises glass-filled polypropylene or glass-filled nylon.

In the second embodiments or any other of the disclosed embodiments, the end of the first leg is coupled to the impeller by at least one bushing that allows the respective blade to rotate from the collapsed position to the extended position.

In the second embodiments or any other of the disclosed embodiments, a region surrounding the at least one bushing includes a plurality of ribs extending along a direction of elongation of the first leg or has a thickness greater than that of other regions of the first leg.

In one or more third embodiments, a method of mixing a substance in a container comprises inserting a mixing device into the container with the substance therein. The mixing device includes a shaft and an impeller mounted thereon. The impeller includes at least two plastic blades coupled thereto by respective bushings. Each blade is at a collapsed position during the inserting. The method further comprises rotating the mixing device such that each plastic blade displaces from the collapsed position to an extended position and to mix the substance in the container. The bushings allow the at least two plastic blades to rotate from the collapsed position to the extended position during said rotating, and each plastic blade comprises polypropylene or nylon.

In the third embodiments or any other of the disclosed embodiments, each impeller blade comprises 30% glass-filled polypropylene, 60% glass-filled polypropylene, or at least 70% glass-filled nylon.

In the third embodiments or any other of the disclosed embodiments, each blade has a first leg and a second leg in cross-section joined together at adjacent edges and at least one support rib extending between the first and second legs. An angle between the first and second legs is 135° or less, and a length of the second leg to a length of the first leg is at least 1.8:1.

In the third embodiments or any other of the disclosed embodiments, a region of each blade surrounding the bushings has a plurality of ribs extending along a direction of elongation of the blades.

In the third embodiments or any other of the disclosed embodiments, the substance is a heterogeneous mixture, prone to separation of component ingredients.

In the third embodiments or any other of the disclosed embodiments, the substance is a seed treatment product.

In one or more fourth embodiments, a mixing device comprises an elongated shaft, a first impeller sleeve, and at least two first impeller blades. The elongated shaft has a central axis of rotation. The first impeller sleeve is mounted on the shaft. The at least two first impeller blades comprise an attachment leg and a stirring leg extending from the attachment leg. Each first impeller blade is supported by the first impeller sleeve so as to transition from a collapsed position with the stirring leg proximal to the central axis of the shaft to an extended position with the stirring leg extending away from the central axis when the shaft is rotated.

In the fourth embodiments or any other of the disclosed embodiments, wherein each first impeller blade comprises a plastic material.

In the fourth embodiments or any other of the disclosed embodiments, the stirring leg extends at an angle from the attachment leg. The angle can be 135° or less. In the collapsed position, a ratio of a length of the stirring leg in plan view to a length of the attachment leg in plan view is at least 1.8:1.

In the fourth embodiments or any other of the disclosed embodiments, each first impeller blade comprises glass-filled polypropylene or glass-filled nylon.

In the fourth embodiments or any other of the disclosed embodiments, each first impeller blade includes at least two support ribs. Each support rib extends from a face of the stirring leg and connects the attachment and stirring legs.

In the fourth embodiments or any other of the disclosed embodiments, the mixing device further comprises a second impeller sleeve and at least one second impeller blade. The second impeller sleeve is mounted on the shaft between the base and the first impeller sleeve. The at least one second impeller blade is supported by the second impeller sleeve.

In the fourth embodiments or any other of the disclosed embodiments, the second impeller sleeve and the at least one second impeller blade are constructed such that a stirring leg of each second impeller blade does not overlap the second impeller sleeve in plan view. The first impeller sleeve and the at least one first impeller blade are constructed such that the stirring leg of each first impeller blade does overlap the first impeller sleeve in the plan view.

In the fourth embodiments or any other of the disclosed embodiments, the attachment leg of each first impeller blade includes an attachment portion with at least one bushing extending from a surface thereof. The first impeller sleeve includes corresponding holes or recesses that receive said at least one bushing, and the holes or recesses and the at least one bushing are constructed to allow the corresponding first impeller blade to rotate from the collapsed position to the extended position.

In the fourth embodiments or any other of the disclosed embodiments, the mixing device further comprises means for applying a rotational force to the shaft, such as a motor and/or a base that transmits motion from the motor or a manually actuated handle to the shaft.

In the fourth embodiments or any other of the disclosed embodiments, each first impeller blade includes a living hinge that allows it to transition to the extended position. The living hinge connects the attachment leg to the stirring leg or comprising part of the stirring leg.

In the fourth embodiments or any other of the disclosed embodiments, each first impeller blade has a curved shape in profile and/or is propeller-shaped.

In the fourth embodiments or any other of the disclosed embodiments, at least a first region of the attachment leg of each first impeller blade has a plurality of ribs. The first region can be proximal to the first impeller sleeve.

In the fourth embodiments or any other of the disclosed embodiments, each of the plurality of ribs extends longitudinally in a direction of elongation of the first impeller blade.

In the fourth embodiments or any other of the disclosed embodiments, a support rib extends along a first direction between a face of the stirring leg and a face of the attachment leg. Each of the plurality of ribs extends along a second direction perpendicular to or at least crossing the first direction. The support rib bounds the first region.

In the fourth embodiments or any other of the disclosed embodiments, a number, size, and spacing of the plurality of ribs is such that at least 40% of the area in the first region is covered by the ribs.

In the fourth embodiments or any other of the disclosed embodiments, the first region is an attachment portion with at least one bushing protruding from at least one surface thereof. The at least one surface includes the plurality of ribs.

In the fourth embodiments or any other of the disclosed embodiments, at least a first region of the attachment leg of each first impeller blade has a thickness greater than that of other regions of the attachment leg. The first region can be proximal to the first impeller sleeve.

In one or more fifth embodiments, a mixing device comprises an elongated shaft and an impeller. The elongated shaft has a longitudinal axis. The impeller is mounted on the shaft and comprises at least two blades constructed to displace from a collapsed position to an extended position upon rotation of the shaft. Each blade has a first leg and a second leg in cross-section joined together at adjacent edges and at least one support rib extending between the first and second legs. An end of the first leg is coupled to the impeller. An angle between the first and second legs is 135° or less, and a length of the second leg to a length of the first leg is at least 1.8:1.

In the fifth embodiments or any other of the disclosed embodiments, the at least two blades comprise a plastic material.

In the fifth embodiments or any other of the disclosed embodiments, each blade comprises glass-filled polypropylene or glass-filled nylon.

In the fifth embodiments or any other of the disclosed embodiments, the at least two blades is at least four blades.

In the fifth embodiments or any other of the disclosed embodiments, the end of the first leg is coupled to the impeller by at least one bushing that allows the respective blade to rotate from the collapsed position to the extended position. A region surrounding the at least one bushing includes a plurality of ribs extending along a direction of elongation of the first leg or has a thickness greater than that of other regions of the first leg.

In one or more sixth embodiments, a method of mixing a substance in a container comprises inserting a mixing device into the container with the substance therein. The mixing device includes a shaft having a rotation axis and an impeller mounted to the shaft. The impeller includes at least two blades coupled thereto, and each blade is at a collapsed position during the inserting. The method further comprises rotating the shaft about the rotation axis such that each impeller blade displaces from the collapsed position to an extended position, thereby mixing the substance in the container. Each impeller blade has a first leg and a second leg in cross-section joined together at adjacent edges and at least one support rib extending between the first and second legs.

In the sixth embodiments or any other of the disclosed embodiments, each impeller blade comprises a plastic material.

In the sixth embodiments or any other of the disclosed embodiments, each impeller blade comprises 30% glass-filled polypropylene, 60% glass-filled polypropylene, or at least 70% glass-filled nylon.

In the sixth embodiments or any other of the disclosed embodiments, an angle between the first and second legs is 135° or less, and a length of the second leg to a length of the first leg is at least 1.8:1.

In the sixth embodiments or any other of the disclosed embodiments, a region of each blade surrounding said bushings has a plurality of ribs extending along a direction of elongation of the blades.

In the sixth embodiments or any other of the disclosed embodiments, the substance is a heterogeneous mixture prone to separation of component ingredients.

In the sixth embodiments or any other of the disclosed embodiments, the substance is a product for treatment of seeds.

Features of the disclosed embodiments may be combined, rearranged, omitted, etc., within the scope of the invention to produce additional embodiments. Furthermore, certain features may sometimes be used to advantage without a corresponding use of other features.

It is thus apparent that there is provided in accordance with the present disclosure, system, methods, and devices for mixing a substance using extendible impellers. Many alternatives, modifications, and variations are enabled by the present disclosure. While specific embodiments have been shown and described in detail to illustrate the application of the principles of the present invention, it will be understood that the invention may be embodied otherwise without departing from such principles. Accordingly, Applicants intend to embrace all such alternatives, modifications, equivalents, and variations that are within the spirit and scope of the present invention.

The invention claimed is:

1. A mixing device comprising:

a base constructed to be releasably attached to an opening of a container;

a shaft extending from the base and coupled thereto such that rotation is transmitted to the shaft by way of or through the base;

a first impeller sleeve mounted on the shaft; and at least one first impeller blade comprising an attachment leg and a stirring leg extending from the attachment leg, each first impeller blade being supported by the first impeller sleeve so as to transition from a collapsed position with the stirring leg proximal to a central axis of the shaft to an extended position with the stirring leg distal from the central axis when the shaft is rotated, wherein each first impeller blade includes at least one support rib extending from a face of the stirring leg.

2. The mixing device of claim 1, wherein the stirring leg extends at an angle from the attachment leg, the angle being 135° or less.

3. The mixing device of claim 1, wherein, in the collapsed position, a ratio of a length of the stirring leg in plan view to a length of the attachment leg in plan view is at least 1.8:1.

4. The mixing device of claim 1, wherein each first impeller blade comprises glass-filled polypropylene or glass-filled nylon.

5. The mixing device of claim 1, wherein the at least one first impeller blade comprises two first impeller blades.

6. The mixing device of claim 1, further comprising:

a second impeller sleeve mounted on the shaft between the base and the first impeller sleeve; and at least one second impeller blade supported by the second impeller sleeve.

7. The mixing device of claim 6, wherein:

the second impeller sleeve and the at least one second impeller blade are constructed such that a stirring leg of each second impeller blade does not overlap the second impeller sleeve in plan view, and the first impeller sleeve and the at least one first impeller blade are constructed such that the stirring leg of each first impeller blade does overlap the first impeller sleeve in the plan view.

8. The mixing device of claim 1, wherein:

the attachment leg of each first impeller blade includes an attachment portion with a bushing extending from a surface thereof, the first impeller sleeve includes a hole or recess that receives said bushing, and the hole or recess and the bushing are constructed to allow the corresponding first impeller blade to rotate from the collapsed position to the extended position.

9. The mixing device of claim 1, wherein:

the attachment leg of each first impeller blade includes an attachment portion with a pair of bushings extending from opposite surfaces thereof, the first impeller sleeve includes corresponding holes or recesses that receive the bushings, and the holes or recesses and the bushings are constructed to allow the corresponding first impeller blade to rotate from the collapsed position to the extended position.

10. The mixing device of claim 1, wherein the base includes a motor that provides a rotational force to the shaft or is constructed to transmit a rotational force from a motor to the shaft.

11. The mixing device of claim 1, wherein each first impeller blade includes a living hinge that allows it to transition to the extended position, the living hinge connecting the attachment leg to the stirring leg or comprising part of the stirring leg.

12. The mixing device of claim 1, wherein each first impeller blade has a curved surface or is propeller-shaped.

13. The mixing device of claim 12, wherein each of the plurality of reinforcing structures extend longitudinally in a direction of elongation of the first impeller blade.

14. The mixing device of claim 1, wherein at least a first region of the attachment leg of each first impeller blade has a plurality of reinforcing structures, the first region being proximal to the first impeller sleeve.

15. The mixing device of claim 14, wherein:

the support rib extends along a first direction between a face of the stirring leg and a face of the attachment leg, each of the plurality of reinforcing structures extends along a second direction perpendicular to or at least crossing the first direction, and the support rib bounds the first region.

16. The mixing device of claim 14, wherein the first region is an attachment portion with at least one bushing protruding from at least one surface thereof, the at least one surface including the plurality of reinforcing structures.

17. The mixing device of claim 1, wherein at least a first region of the attachment leg of each first impeller blade has a thickness greater than that of other regions of the attachment leg, the first region being proximal to the first impeller sleeve.

18. A mixing device comprising:

a base constructed to be releasably attached to an opening of a container;

a shaft coupled to the base; and an impeller mounted on the shaft and comprising at least two blades constructed to displace from a collapsed position to an extended position upon rotation of the shaft, each blade having a first leg and a second leg in cross-section joined together at adjacent edges and at least one support rib extending between the first and second legs, an end of the first leg being coupled to the impeller, wherein an angle between the first and second legs is 135° or less, and a length of the second leg to a length of the first leg is at least 1.8:1.

19. A method of mixing a substance in a container, the method comprising:

inserting a mixing device into the container with the substance therein and/or adding the substance after the inserting, the mixing device including a shaft and an impeller mounted thereon, the impeller including at least two blades coupled thereto by respective bushings, each blade being at a collapsed position during the inserting; and rotating the mixing device such that each blade displaces from the collapsed position to an extended position and to mix the substance in the container, wherein the bushings allow the at least two blades to rotate from the collapsed position to the extended position during said rotating, wherein each impeller blade comprises a first leg and a second leg in cross-section joined together at adjacent edges and at least one support rib extending between the first and second legs, an end of the first leg being coupled to the impeller.

* * * * *